United States Patent [19]

Beall, III

[11] Patent Number: 4,932,652

[45] Date of Patent: Jun. 12, 1990

[54] MARTIAL ARTS TRAINING APPARATUS

[76] Inventor: John N. Beall, III, 319 NE. 72nd St., Seattle, Wash. 98115

[21] Appl. No.: 243,639

[22] Filed: Sep. 13, 1988

[51] Int. Cl.[5] ..... A63B 69/00

[52] U.S. Cl. ..... 272/76

[58] Field of Search ..... 272/76, 77, 78, 140, 272/141, 142, 93, 101, 102, 110, 116, 135, 136, 137; 273/55 A, 55 R

[56] References Cited

U.S. PATENT DOCUMENTS

| | | | |
|---|---|---|---|
| 305,406 | 2/1929 | McNamara | 272/76 |
| 2,223,309 | 11/1940 | Swanson | 272/141 |
| 3,250,533 | 5/1966 | Nicholson, II | 272/76 |
| 3,421,759 | 1/1969 | Chambers | 272/76 |
| 3,888,481 | 6/1975 | Adams, Jr. et al. | 272/76 |
| 4,635,929 | 1/1987 | Shustack | 272/76 |

FOREIGN PATENT DOCUMENTS

| | | |
|---|---|---|
| 460060 | 10/1972 | U.S.S.R. . |
| 1063424 | 12/1983 | U.S.S.R. . |

OTHER PUBLICATIONS

Black Belt Magazine, Jul. 1984, p. 7.

*Primary Examiner*—Stephen R. Crow
*Attorney, Agent, or Firm*—Patrick M. Dwyer

[57] ABSTRACT

The invention comprises a martial arts training apparatus which resembles in movement and function a human leg, particularly in response to a well executed low kick. Leg 10 is mounted to a base 9 upon a bracket 12 above a floor 11 upon which the martial arts trainee stands. The leg comprises an upper leg 20, a lower leg 21 and an extendable foot 47. Upper leg 20 and lower leg 21 are connected by cable 31 and spring 32. A properly executed low kick to leg 10 will cause the leg to "break", pivoting lower leg 21 and upper leg 20 about lower ball 22, and upper leg 20 about upper ball 19 in base 9.

18 Claims, 1 Drawing Sheet

MARTIAL ARTS TRAINING APPARATUS

TECHNICAL FIELD

This invention relates to the field of martial arts training, particularly to an apparatus for training in the use and proper execution of a low kick, and more particularly to apparatus capable of simulating the response of a human leg to a well executed low kick.

BACKGROUND

One of the most basic and essential martial arts techniques is the proper execution of what is known as a low kick. That is, a low kick by the martial artist is to the lower extremity of the leg of an opponent, usually the forward leg. In principle, this blow is easily taught and demonstrated but in application and execution, subtleties are sometimes difficult to master without practice on a human leg. The primary purpose of such a blow to a human leg is to discourage further attack and, if necessary, to break the leg at the knee. A properly executed blow can cause severe permanent damage to the human leg and is therefore commonly avoided in practice situations.

The alternative then is to aim kicks at a non human leg is order that no one be hurt. The disadvantage, however, is that upon being kicked, presently available non human leg substitutes do not respond as a human leg would respond and the trainee misses important subtleties in the execution and delivery of the low kick.

Various devices are known in the martial arts field employing spring loaded appendages but none of these have been found suitable for training in the execution of low kicks. No known devices permit a humanlike "breakage" response when kicked, while permitting return of the leg to a practice position for reuse.

DISCLOSURE OF THE INVENTION

Accordingly it is an object of the invention to provide a martial arts training apparatus resembling in movement and function a human leg.

It is a further object of the invention to provide a simulation of a human leg as a martial arts training apparatus which may be broken at the knee by a properly executed kick but which will not collapse if the kick is not properly executed.

It is another object of the invention to provide a simulation of a jointed human leg which is held together by a tensioning mechanism sufficient to resist the breaking tendency of a frontal, side, or oblique frontal kick to the leg in a manner analogous to the strength and resilience of human tissue and bone.

It is a further object of the invention to provide a simulated human leg as above with spring and cable tensioning mechanism and an extendable foot so that the leg may be placed in a bent position with the force of the tensioning mechanism thereby holding the foot to the ground to resist a kick or sweep.

The above objects and other which will become apparent from the disclosure herein are accomplished by the invention as more fully described below.

The invention is a martial arts training apparatus which resembles in movement and function a human leg, particularly in response to a well executed low kick. The apparatus comprises a foot, a leg, a base, and, in a preferred embodiment, a mounting bracket. The mounting bracket is anchored to some suitable mounting surface such as a wall, or, in one embodiment, a "wooden dummy" or mookjong. The mookjong is essentially a length of log suspended from a frame which is commonly employed in certain Chinese martial arts practice.

The base is mounted to the bracket through a base member by means of a threaded eye bolt which passes through the base member and the mounting bracket with the eye of the bolt downwards. The leg is attached to the base as described below. The bracket is so placed as to permit placing of the leg in either straight or bent position upon a floor surface from which the martial arts trainee exercises and in a preferred embodiment is angled upward, at its uppermost end, at a 30 degree angle.

The leg further comprises an upper leg, and a lower leg. Slidably engaged within the lower leg, is a leg extension upon which the foot is pivot mounted. The lower leg is held in engagement with the upper leg, and the leg is in turn held in engagement with the base, by means of a cable and spring or other tensioning means. In a preferred embodiment the cable at its lower end is attached at some point in the upper portion of the lower leg in such a way as to permit tension adjustment. The cable then passes through an alignment guide, which in a preferred embodiment is a trailer hitch ball affixed in and protruding from the lower end of the upper leg, and terminates inside the upper leg in a loop to which can be attached the spring. Other lower end attachment arrangements of the cable, other alignment guides, and other upper end terminations will serve as well. For instance, the lower end of the cable need not be tension adjustable and can be attached anywhere in the lower leg so long as the attachment does not interfere with the range of telescopic movement of the leg extension. Also the upper end of the cable need not be looped, but can attach to the spring in any conventional manner and the alignment guide may be some other hemispherical protrusion from the lower end of the upper leg, or can be bullet shaped, conical, or other tapered shapes. A number of different substantially hollow tubing materials may be employed in the invention. However in a preferred embodiment, durability and economy are of primary concern. Thus, ordinary schedule 40 2" i.d. steel pipe is used and cut into sections approximately the dimensions of a human upper and lower leg respectively for the upper leg and lower leg of the invention. The base is a 2" section of the same type and diameter pipe. The leg extension to which the pivoting foot is attached is ordinary schedule 40 1 ½" i.d. steel pipe, and the foot itself is a 3"×9" piece of ½" thick cold steel plate to which is welded a tab drilled for insertion of a pivoting pin in a well known and conventional manner. However, non-cylindrical tubing or even square tubing may be employed without departing from the scope of the invention, and respective tubing diameters for upper and lower legs and for base need not be the same.

Finally the upper end of the spring is attached to the eye of the eye bolt which is holding the base to the mounting bracket. Spring and cable tension thus holds lower leg and upper leg together and the leg in turn to the base. The base also contains a downwardly projecting alignment guide which can differ in shape from the one at the joint of the lower leg and upper leg, but in a preferred embodiment it is identical.

The cable and spring create a tensioning force through the apparatus which tends to pull the leg into its shortest possible alignment; that is, a straight leg.

Where cylindrical tubing is employed as in a preferred embodiment, the leg may be bent at the "knee" joint, with a portion of the rim of the upper end of the lower leg pivoting upon a portion of the rim of the lower end of the upper leg while adjacent upper and lower leg ends are held in alignment by the alignment guide. In the same way, the leg may be bent at the joint of upper leg and base.

Where different diameter tubing is employed for upper and lower legs and for base and upper leg, the smaller inside diameter tubing needs to be employed as the respective lower member. That is, lower leg, if different in diameter from upper leg, would need to be the smaller in diameter, and upper leg would similarly need to be smaller in diameter than the base. Where differing diameters are employed as just described, the pivoting and bending at "knee" joint and joint of upper leg and base necessarily occurs on a portion of the respective alignment guides, instead of respectively opposed tubing ends making rim to rim contact.

The leg is thus bent against the tension of the spring and cable. Because the cable naturally tends to assume the shortest possible position, it tends to pull the lower leg back around and into a straight leg position. However, with the extendable foot in contact with the floor, this same tendency to straighten the leg makes the foot act as if it were "weighted", as if by a standing human leg.

The cable may be of the stranded steel type, of length sufficient to pass from an upper portion of the lower leg through the ball at the "knee" joint and several inches into the upper leg and terminating at its upper end in a swaged loop. The lower end of the cable may be terminated in a cable clamping device which has, integral to it, a threaded rod distal to the lower cable end, or a clamp may also be clamped both to a threaded rod and the cable. The threaded rod passes through a support bracket welded within an upper portion of the lower leg. An ordinary adjusting nut then conventionally serves to adjust the tension in the cable by simple turning of the nut upon the threaded rod protruding through the support bracket. Any suitable coil spring may be employed, either of the straight or proportional variety, although for simplicity and economy a common straight coil spring of approximately 1½" outside diameter is preferred. In a preferred embodiment the initial spring tension is in the range of 60 to 80 pounds and spring rate is 180 pounds. A broader range of initial spring tensions and other spring rates will occur to persons having ordinary skill in the art without departing from the scope of the invention. The lower end of the spring is attached to the cable and the upper end of the spring is attached to the eye of the eye bolt which holds the base member to the bracket.

As noted above, the alignment guides at the lower end of the upper leg member and at the lower end of the base member may be ordinary trailer hitch balls drilled through their centers for free passage of the cable and eye bolt, respectively, and welded into the lower ends of their respective pipes so that the "ball" protrudes from the lower end of its pipe to expose substantially a full hemisphere. However any suitable spherical, hemispherical, or even conical or bullet shaped profile will serve the purpose of aligning the upper leg with the base and the lower leg with the upper leg during the bending, breaking, and pivoting motions of the leg members with respect to one another.

The mounting bracket may be made of ordinary 7/16 thick steel, approximately 23" long and 3" wide with a 60 degree bend at the top through which a hole is drilled for passing the eye bolt which holds the base to the mounting bracket. Of course, other materials will occur to those skilled in the art and new materials may be developed which are superior in durability and economy to those disclosed herein without departing from the scope of the invention as disclosed and claimed in this application.

The rear portions of the upper leg and lower leg pipes are relieved with slotted openings along most of their lengths for access to and inspection of the cable, springs, and adjusting nuts. The extendable foot is adjustably held in position by an ordinary set bolt threadably engaging a lower portion of the lower leg to impinge upon the outer surface of the leg extension to releasably hold it frictionally in place inside the lower leg. This extendable foot serves not only to facilitate placement of the foot of the simulated leg upon the ground no matter whether the leg is in a straight or bent position, it also serves, in an embodiment where the mounting bracket is mounted to a mookjong or other hanging mounting surface which is itself height adjustable, to place the foot of the apparatus upon the floor no matter what height the mookjong is set to.

BEST MODE FOR CARRYING OUT THE INVENTION

Figure 1:
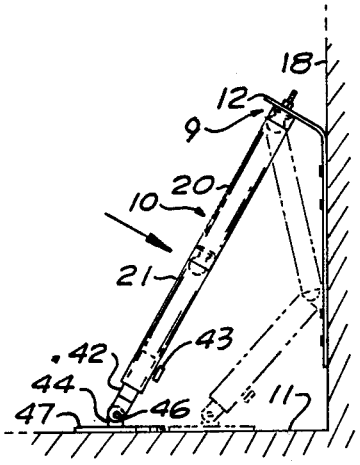
FIG. 1 is side elevation of an embodiment of the apparatus of the invention shown in its straight position, with the phantom lines illustrating a "broken" position to the rear.

Referring now to the drawings wherein like numbers indicate like parts, a preferred embodiment is described.

Figure 4:
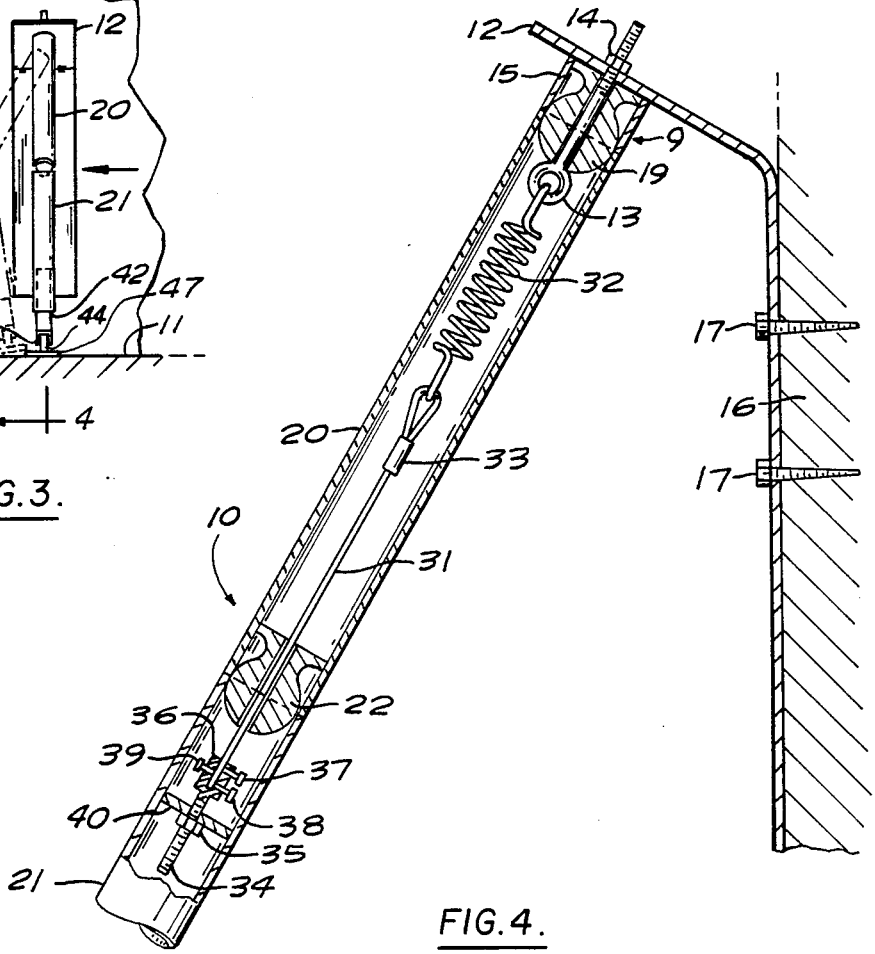
FIG. 4 is a partial elevational cross-section taken along lines 4—4 in FIG. 3, also depicting an alternate mounting surface (adjustable foot not shown).

In FIGS. 1 and 4, a base 9 is shown mounted to a mounting bracket 12 from which leg 10 depends to floor 11. Base 9 consists of base tube 15 within which is welded upper ball 19 through which passes eye bolt 13 for holding base 9 to bracket 12 by nut 14. Upper ball 19 in a preferred embodiment is a simple trailer hitch ball drilled to receive eye bolt 13. The base of the trailer hitch ball is welded within base tube 15 to make base 9 a rigid assembly. However other durable and suitably rigid constructions will serve the same function in base 9 provided they have a lip edge surface against which an upper lip edge surface of upper leg 20 may pivot in an end aligned relationship with base tube 15, which end aligned relationship is fostered and assisted by a tendency of the upper end of upper leg 20 to align itself upon a hemispherical lower projecting portion of upper ball 19.

Bracket 12 is rigidly mounted by well known means, such as bolts, to a wall surface 18 or, in an alternate embodiment, to a hanging mookjong 16. In a preferred embodiment this mounting is carried out by means of bolts 17. Bracket 12 is mounted to wall surface 18 at such a height as to allow straight positioning of leg 10 with foot 47 in contact with floor 11. It has been found that positioning upper ball 19 at approximately the same height above floor 11 as the height of a standing adult human hip joint works well for adjustability of leg positioning.

Leg 10 consists of upper leg 20 and lower leg 21. In the lower end of upper leg 20 is welded lower ball 22 in a manner analogous to the welding of upper ball 19 in base tube 15. Lower ball 22 is a trailer hitch ball of the same diameter as that employed in upper ball 19. It is not critical that the trailer hitch ball diameters be exactly the same as the inside diameters of the pipes from which the leg members are made, although substantial deviations in the respective diameters will cause poor pivoting action of the lower leg about the upper leg and may result in a binding of the lower leg which would detract from the simulation quality of the invention. The preferred embodiment employs two trailer hitch balls of substantially the same diameter as the inside diameter of the leg member pipes.

Welded into an upper portion of lower leg 21 is support bracket 40 which is drilled substantially in its center with a hole for receiving cable tensioning bolt 34 which is adjusted by nut 35. Cable tensioning bolt 34 may be integral with cable clamp 36 as shown, or may be clamped to it, and cable clamp 36 holds by means of the compressive force of clamp screws 37, 38, and 39 the lower end of cable 31. Cable 31 passes through the drilled lower ball 22 and terminates at its upper end several inches further into upper leg 20 in a conventionally swaged loop. Through the swaged loop, the lower end of spring 32 is engaged, and the upper end of spring 32 is engaged in the eye of eye bolt 13. Attaching, adjusting, and clamping of the cable is all accomplished through slots (not shown) in the rear of the upper leg and lower leg. When cable 31 and spring 32 are attached, the upper and lower legs are held together and leg 10 is held to base 9 under tension. Upper leg 20, lower leg 21, and base 9 are held in mutual engagement as shown in FIG. 1 only by the tensioning force of spring 32 and cable 31. Thus, upper leg 20 is free to pivot against base tube 15 and upper ball 19, and lower leg 21 is free to pivot against upper leg 20 and lower ball 22. Thus, the parts of the invention are free to interact with one another and move in a manner resembling the action of a broken human leg.

Disposed for sliding and telescopic engagement within lower leg 21 is leg extension 42 which is releasably held in position by set bolt 43 after an appropriate extension has been determined. Pivotally engaging the lower end of leg extension 42 in conventional manner is foot 47 by way of tab 44 about pivot 46.

Figure 2:
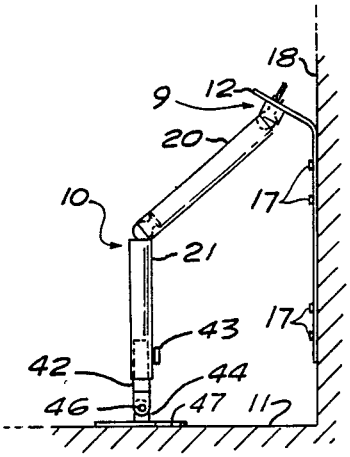
FIG. 2 is a side elevation of the same embodiment shown in FIG. 1, but depicted in a "bent knee" position.

During use of the apparatus, a trainee aims a low kick to leg 10 in the direction indicated by the arrow in FIG. 1. An improperly delivered low kick fails to collapse lower leg 21 with respect to upper leg 20. A properly executed low kick collapses leg 10 backwardly from the direction of the kick into a position approximately shown in FIG. 1 in phantom lines. Alternatively a trainee may kick leg 10 after it has been placed in the bent position shown in FIG. 2 obliquely from the front with approximately the same results, for a well executed kick, as those shown by the phantom lines in FIG. 1. Alternatively the bent leg 10, as shown in FIG. 2 from the side and as shown in FIG. 3 from the front, may be kicked either directly from the side or obliquely from the front and to the side with the result that a properly executed kick will collapse the leg in the direction shown by the phantom lines in FIG. 3.

Figure 3:
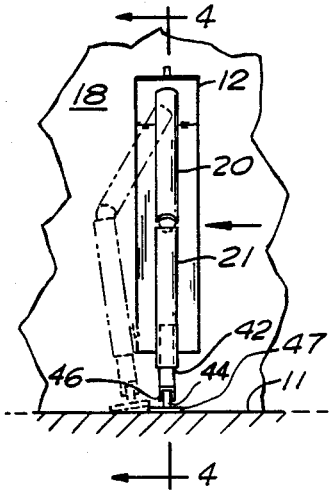
FIG. 3 is a front elevation of the view shown in FIG. 2 with phantom lines illustrating a "broken" position to the side.

Improperly executed blows or properly executed but not sufficiently forceful blows will cause pivoting movements about the joints of leg 10 but will not result in the collapse of the leg as shown by the phantom lines in FIGS. 1 and 3. Instead the leg will be deformed through minor pivoting at the joints, but will then snap back into its preset "on guard" position under the influence of the tension of the cable and spring. After a successful and properly executed kick resulting in collapse of the leg as shown in FIGS. 1 and 3, the trainee or the instructor simply moves the leg back into a suitable "on guard" position for further practice. The trainee or instructor may position the leg to any desired straight or bent position, adjusting the extendable foot as required to keep the foot in contact with the floor surface. Suitable positions will be apparent to those skilled in the applicable martial arts.

INDUSTRIAL APPLICABILITY

This invention will find use in the martial arts training and sports industry in situations where a durable training device, resembling in action the response of a human leg when kicked, would be useful in training for lower kicks.

The device is made of durably constructed and easily assembled materials, is inexpensive to make, and may be mounted upon a number of different possible mounting surfaces, including mounting to a "wooden dummy" or mookjong used in Chinese martial arts.

In compliance with the statute, the invention has been described in language more or less specific as to structural and functional features. It is to be understood, however, that the invention is not limited to the specific features shown, since the means of construction and method herein disclosed comprise only a preferred form of putting the invention into effect. Other modifications and other variations of my apparatus and method will occur to those of ordinary skill in the art. Accordingly, the foregoing description is to be interpreted in an illustrative, and not in a limitative, sense and the invention is claimed in any of its forms or modifications within the legitimate, valid scope of the appended claims appropriately interpreted in accordance with the doctrine of equivalents.

I claim:

1. A martial arts training apparatus for training in the proper execution of a low kick, the apparatus comprising:

a base, an upper leg, a lower leg, and a foot; wherein said foot pivotally engages the lower end of said lower leg and wherein said lower leg, said upper leg, and said base are further comprised of substantially hollow tubing; and wherein the lower end of said upper leg terminates in a lower alignment guide where the longest diameters of said lower alignment guide taken at the termination of said upper leg are substantially equal to but not greater than the inside diameter of said upper leg, said lower alignment guide acting to align the upper end of said lower leg with the lower end of said upper leg; and wherein the lower end of said base terminates in an upper alignment guide, where the longest diameters of said upper alignment guide are substantially equal to but not greater than the inside diameter of said base, said upper alignment guide acting to align the lower end of said base with the upper end of said upper leg; and wherein a cable is attached at a point within said lower leg, said cable running through a hole in said lower alignment guide and terminating in said upper leg, and wherein a spring connects the upper end of said cable to said base, and whereby said legs pivot in response to a kick by the trainee.

2. The apparatus of claim 1 wherein said spring is of a conventional proportionally wound type.

3. The apparatus of claim 1 wherein said lower leg, said upper leg, and said base are each comprised of substantially cylindrical tubing.

4. The apparatus of claim 3 wherein said lower leg, said upper leg, and said base are each of substantially the same inside diameter.

5. A martial arts training apparatus comprising:

a base having in its lower end an upper alignment guide;

an upper leg having in its lower end a lower alignment guide;

a lower leg having pivotally attached to its lower end a foot;

a spring located within said upper leg and connected at its upper end to said base;

a cable connected at its lower end to an inner portion of said lower leg, passing through a hole in said lower alignment guide, and connected at its upper end to a lower end of said spring;

whereby said base, upper leg, and lower leg are held together by said cable and spring, and whereby said upper leg is aligned to said base upon said upper alignment guide and said lower leg is aligned to said upper leg said lower alignment guide; and whereby said legs pivot in response to a kick by the trainee.

6. The apparatus of claim 5 wherein said base is attached to a mounting surface to depend from said surface at an angle substantially below the horizontal.

7. The apparatus of claim 6 wherein said angle is 60 degrees.

8. The apparatus of claim 7 wherein said mounting surface is a vertical surface of a hanging mookjong.

9. The apparatus of claim 7 wherein said mounting surface is vertical and further comprising a mounting bracket having an upper portion angled at an angle of substantially 60 degrees with respect to the plane of a lower portion of said bracket, said lower portion drilled to accept conventional mounting bolts for mounting said mounting bracket to said mounting surface; wherein said base is mounted to said upper portion of said mounting bracket so that when said mounting bracket is mounted upon said mounting surface said base, said upper leg, said lower leg, and said foot depend one from the other respectively.

10. The apparatus of claim 9 wherein said spring is a conventionally wound coil spring of initial spring tension in the range of 60 to 80 pounds, with spring rate of substantially 180 pounds.

11. The apparatus of claim 9 wherein said base is mounted to said mounting bracket by passing an eye bolt through said upper alignment guide of said base and through said mounting bracket, and wherein said spring is connected at its upper end to said eye bolt.

12. The apparatus of claim 9 wherein said lower alignment guide and said upper alignment guide are a lower ball and an upper ball, respectively, having substantially the same diameter as the inside diameter of said upper leg and said base respectively; wherein said lower ball and said upper ball are affixed so that a full hemisphere protrudes from within said upper leg and said base, respectively.

13. The apparatus of claim 12 wherein said inner portion of said lower leg comprises a support bracket attached within said lower leg, said support bracket being relieved in its center in such a way that a threaded rod may be passed therethrough for engagement with an adjusting nut below, said threaded rod terminating above said support bracket in a means to clamp the lower end of said cable; whereby tension in said cable may be adjusted by turning said adjusting nut.

14. The apparatus of claim 5, wherein said foot pivotally engages the lower end of a leg extension, said leg extension slidably engaged within a lower portion of said lower leg, said leg extension being releasably and adjustably held within said lower leg by a set bolt.

15. The apparatus of claim 14 wherein said let extension is substantially cylindrical and has a diameter substantially equal to the inside diameter of said lower leg.

16. The apparatus of claim 5 wherein said lower alignment guide and said upper alignment guide are conically shaped.

17. The apparatus of claim 5 wherein said base, upper leg, and lower leg are comprised of substantially hollow tubing.

18. The apparatus of claim 5 wherein the greatest diameters of the upper alignment guide and the lower alignment guide are substantially equal to but not greater than the inside diameter of said base and said upper leg, respectively.

* * * * *